US005957184A

United States Patent [19]

Gross et al.

[11] Patent Number: 5,957,184

[45] Date of Patent: Sep. 28, 1999

[54] TILTER MECHANISM FOR HORIZONTAL BLIND

[76] Inventors: Fred J. Gross; Keith A. Gross, both of 11915 Wicks St., Sun Valley, Calif. 91352

[21] Appl. No.: 09/042,446

[22] Filed: Mar. 16, 1998

[51] Int. Cl.[6] ..... E06B 9/38

[52] U.S. Cl. ..... 160/177 R

[58] Field of Search ..... 160/177 R, 176.1 R, 160/173 R, 168.1 R, 177 V, 176.1 V

[56] References Cited

U.S. PATENT DOCUMENTS

| | | | |
|---|---|---|---|
| 2,580,252 | 12/1951 | Stuber et al. | 160/176.1 R |
| 2,809,531 | 10/1957 | Moyer | 160/176.1 R |
| 5,413,162 | 5/1995 | Ciriaci | 160/177 V |
| 5,636,677 | 6/1997 | Liu | 160/177 R |
| 5,647,422 | 7/1997 | Weng | 160/176.1 V |
| 5,680,892 | 10/1997 | Liu | 160/177 R |

*Primary Examiner*—David M. Purol
*Attorney, Agent, or Firm*—Albert O. Cota

[57] ABSTRACT

A tilter for horizontal slotted blinds which incorporates a hollow housing (22) and lid (34) constructed of a thermoplastic. A spool (48) and gear (50) are attached to a shaft (46) which is retained by the housing and lid. The spool gear intermeshes with a reduction gear cluster which in turn drives a gear driven sleeve (68) through which a tilt rod (74) penetrates. A pair of lines or cords (32) are wound around the spool and hang beneath the blind head rail (28) for manual blind slat tilting. By pulling downward on a selected line the tilter rotates the tilt rod, which in turn rotates conventional drums upon which ladders are attached. The slats of a blind are tilted by gears which are selected to have a ratio that decreases the necessary throw of the line to achieve a full 180 degree tilt of the blind with minimal movement.

17 Claims, 4 Drawing Sheets

TILTER MECHANISM FOR HORIZONTAL BLIND

TECHNICAL FIELD

The invention pertains in general to tilters for horizontal blinds, and more particularly to a tilter using a cord for actuation and gears for transferring direction and reducing the linear movement required to open or close the slats of a horizontal blind.

BACKGROUND ART

Previously, many types of tilters have been used to provide an effective means for producing the required rotational movement to open and close the slats of a horizontal or venetian blind.

In some prior art the slats are partially revolved by a tilter which employs a worm gear that is manually actuated by a rotatable wand, wherein the operator twists the wand the desired direction and the movement is transmitted via an endless screw at right angles to a spur-like gear.

Other developments in the art of horizontal blinds employs a pulley, drum or irregular shaped tilt roll on which a pair of cords or lines are attached. By pulling one or the other line, the actuator rotates the tilt rod proportionally to the line linear movement.

A search of the prior art did not disclose any patents that read directly on the claims of the instant invention, however the following U.S. patents are considered related:

| Pat. No. | INVENTOR | ISSUED |
|---|---|---|
| 5,341,865 | Fraser et al | 30 August 1994 |
| 5,297,608 | Rap et al | 29 March 1994 |
| 4,821,789 | Van Rens | 18 April 1989 |
| 4,676,292 | Valle et al | 30 June 1987 |
| 4,541,468 | Anderson | 17 September 1985 |
| 4,487,243 | Debs | 11 December 1984 |
| 4,352,385 | Vecchiarelli | 5 October 1982 |
| 4,141,402 | Marotto | 27 February 1979 |

U.S. Pat. No. 5,341,865 issued to Fraser et al, teaches a tilt roll mechanism with an asymmetrical cross section and includes bearings on a support to connect flexible cords of ladder laces that extend around the body. Control means are accomplished using a worm gear engaging a pinion with appropriate number of teeth on the worm gear to prevent overtilting.

Rap, et al in U.S. Pat. No. 5,297,608 discloses a tilter mechanism for a venetian blind that employs a fixed hollow drum secured to a headrail and a hollow rotatory mechanism that is positioned in the drum. A tilt cord is wound around the pulley and, when pulled downward, tilts the entire headrail thereby tilting the attached slats.

U.S. Pat. No. 4,821,789 issued to Van Rens is for a tilt drum which secures the upper ends of a cord ladder.

Valle et al in U.S. Pat. No. 4,676,292 teaches a tilter mechanism that uses a spur gear with a smooth peripheral portion having no teeth, and a worm gear that engages the teeth for rotation by a wand.

Anderson in U.S. Pat. No. 4,541,468 also teaches a worm gear that rotatably meshes into engagement with a worm wheel. The wheel has some teeth having a lesser height such that the gear may slip over the shortened teeth to act as a slip clutch.

U.S. Pat. No. 4,487,243 of Debs has a plastic housing open at the top through which a gear and worm shaft are introduced before closing the cover.

Vecchiarelli's U.S. Pat. No. 4,352,385 is for a tilter mechanism employing a worm and wormwheel.

Finally U.S. Pat. No. 4,141,402 of Marotto discloses a tilter operating mechanism that uses a stub shaft that depends from a head rail with a cross piece on a lower stub shaft attaches to a wand.

DISCLOSURE OF THE INVENTION

The prior art related to the inventive tilter mechanism has been basically directed toward using a wand or rigid operating rod for actuating the angular position of the slats which are employed in horizontal or venetian blinds. While this type of manual adjustment has been the accepted method for years, there are many advantages to using a pair of lines or cords for actuation, as a similar type of control is commonly used to raise or lower the blinds. It is therefore a primary object of the invention to employ a tilter mechanism that changes the tilt angle of the slats with a pair of cords or lines each rotating the slats in opposite directions.

Another object of the invention is that the tilter mechanism incorporates two sets of gears. Each gear reverses the direction of rotation such that when drawing down or pulling on the front line, the front of each slat is angled downward with the rear operating in a similar manner but in an opposite direction. Further by the use of gears, the amount of movement required to pull the line relative to the rotation is altered by the gear ratio of each set of gears. This gear reduction ratio decreases the linear movement of the line to open or close the blind by as much as four to one, thus making it easy to operate and obvious in its functional characteristics.

Still another object of the invention is that an operator does not have to reach for the wand, as the cords or lines supplied, have the most convenient length. This characteristic is particularly useful when windows are high and difficult to reach. Further, each line may be grasped simultaneously, one in each hand, and the tilt angle may be quickly and accurately controlled by the operator.

Yet another object of the invention is the utilization of a removable spool that permits the cords or lines to be attached to the spool before it is inserted into the housing. The spool is made with two grooves separated by a barrier each having a hole for inserting the line to which a knot or a clip of metal or plastic retains the lines securely to the spool. The separation of lines prevents them from interwinding and the fact that the attachment and winding procedure is accomplished away from the tilter makes the operation simple and straight forward.

Still another object of the invention includes gears that are all arranged in a horizontal plane. This arrangement allows contact with the tilt rod in the same stratum providing a rugged and robust arrangement unlike prior art that requires vertical gears in their alignment and compliant difficulties. Further, in the horizontal configuration it is easier to change the gear ratio if necessary. In conventional designs, a gear ratio change is difficult since there is a limited space available for gears because the head rail is higher than it is wide. Thus it can be seen that the advantage of this design far overshadows the existing prior art designs. Bevel gears are also well known for their strength and ruggedness and are ideally suited for this application fabricated in either a thermoplastic or metal configuration.

A final object of the invention is the ability to use the mechanism in conventional head rails, as no basic changes are required. The tilter can be simply snapped into a hole that is punched in the bottom of the head rail, and an arm is wedged within the rail interfacing with the formed flange. This feature permits use in most common head rails with systems employing a rotating tilt rod. Physical sizes of the tilter and configurations of the tilt rod may be easily altered without changing the basic concept of the invention.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms of a preferred embodiment. The preferred embodiment, as shown in FIGS. 1–22, is comprised of a hollow housing 22 preferably made of thermoplastic using the injection molding process.

Figure 3:
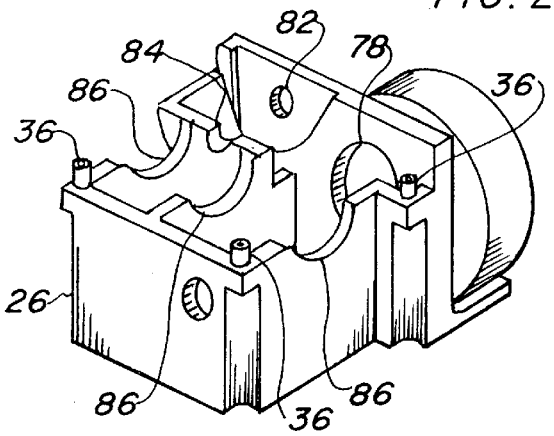
FIG. 3 is a partial isometric view of the housing completely removed from the invention for clarity.
Figure 19:
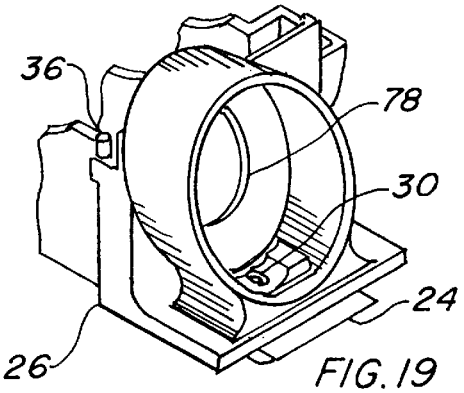
FIG. 19 is a partial isometric view of the housing completely removed from the invention for clarity.
Figure 20:
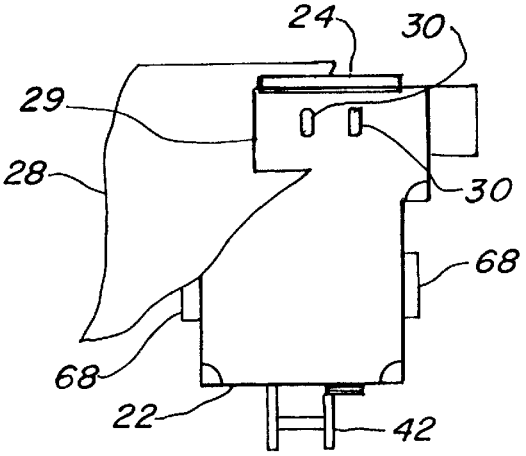
FIG. 20 is a top view of the housing depicting one of the pair of passages in the housing that permit lines to penetrate the housing. This figure also shows also the beveled projection for intersecting a hole in the head rail.
Figure 21:
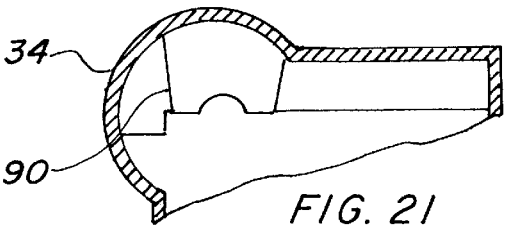
FIG. 21 is a cross section view taken along lines 21—21 of FIG. 4 illustrating the reduction gear keeper.
Figure 22:
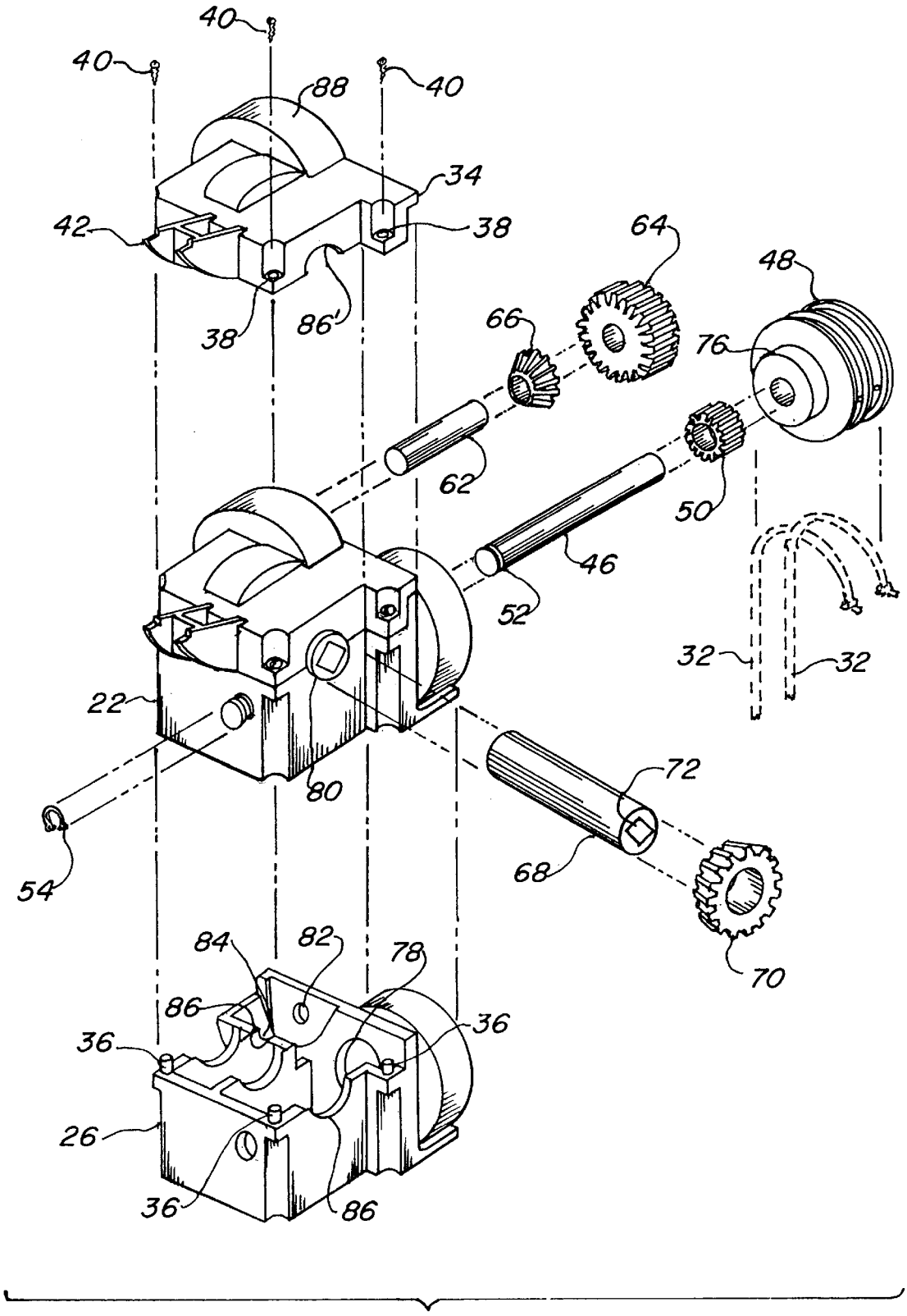
FIG. 22 is an exploded view of the tilter.

The housing 22 is depicted by itself in FIGS. 3, 19 and 20 and includes a downward protruding beveled projection 24 integral with a housing bottom 26 and configured to snap into a hole 29 in a horizontal blind head rail 28.

A pair of passages 30 which are located adjacent to the beveled projection 24 permit flexible lines or cords 32 to pass through the housing bottom 26 and hole 29 in a horizontal blind head rail 28. The lines or cords 32 are illustrated with dotted lines as they are not part of the invention but are essential to its operation. The lines or cords 32 are well known in the art as they are the same structure and material as used to raise and lower the entire blind by lifting the bottom rail on both sides.

Figure 4:
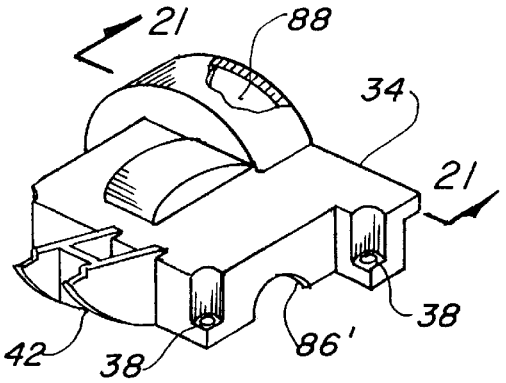
FIG. 4 is a partial isometric view of the lid completely removed from the invention for clarity.

A lid 34, as depicted in FIG. 4, is attached to the housing 22 thus completing the enclosure for the tilter. A plurality of raised bosses 36 project upward from the housing 22 and interface with apertures 38 in the lid for alignment and attachment. Threaded fasteners 40 may be used to affix the lid 34 to the housing 22 through the apertures 38 and threadably penetrating the bosses 36. While the drawings illustrate these threaded fasteners 40 attachment ultra-sonic welding, chemical bonding or adhesive is equally acceptable to make the attachment as the bosses 36 provide the alignment and the parts mate together easily. It should be noted that while bosses and apertures are shown and described, other methods of attachment such as snapping into place, grooves, tabs, indentations and even simple edge to edge mating using adhesive may be utilized.

Figure 1:
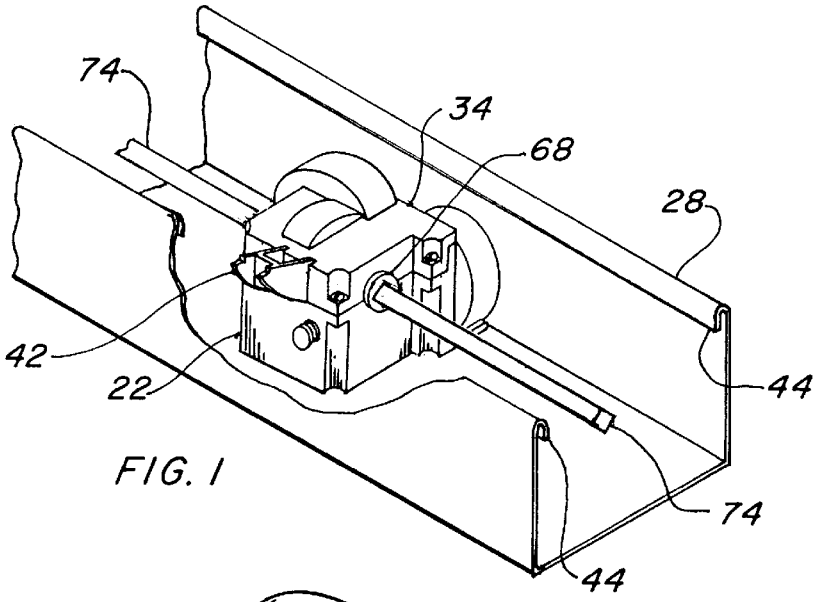
FIG. 1 is a partial isometric view of the preferred embodiment shown installed in a partially cut-away head rail with a tilt rod penetrating the sleeve.
Figure 2:
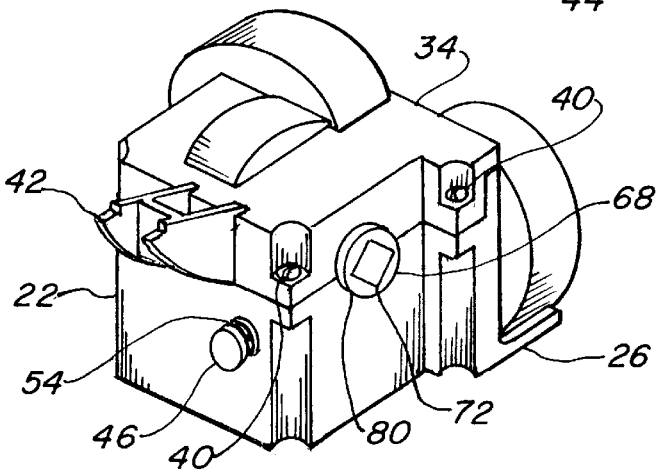
FIG. 2 is a partial isometric view of the preferred embodiment.

In order to attach the tilter into the head rail 28 of the blind, the lid 34 includes an integral outward extending arm 42, as shown in FIGS. 1, 2 and 4, that intersects with a flange 44 that is customarily formed into the upstanding legs of the head rail 28. While FIG. 1 of the drawings depict the head rail and flange 44 partially cut away to illustrate the tilter itself, it is self evident that the arm 42 securely intersects with the flange when the downward protruding beveled projection 24 is snapped into the hole 29 in the head rail as shown in FIG. 20. This attachment method is simple and intitutively obvious to the installer, as the holes 29 that are punched into the bottom of a head rail 28 are common and well known in the art, and flanges 44 are almost always formed into head rails for stiffness. The arm 42 is configured in an "H" shape, however other shapes and forms may be used with equal ease.

The housing 22 and lid 34 are both formed of the same thermoplastic material, which may include: polycarbonate, polystyrene, ABS, polyethylene, polyproplene polyvinylchloroid and the like.

The line actuated spool and gear means are rotatably disposed within the housing 22 and lid 34 and function to attach the pair of lines or cords 32 for transmittal of rotation to the blind by pulling downward on one of the lines, which changes the angular position of the blind slats.

Figure 5:
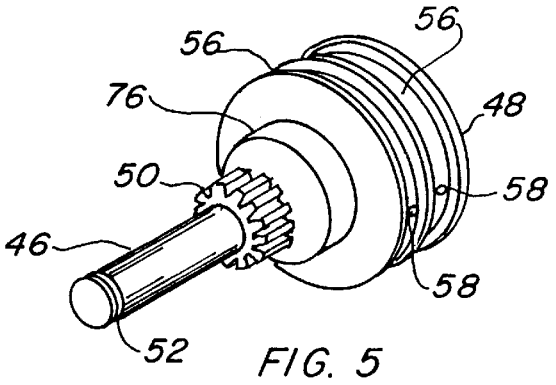
FIG. 5 is a partial isometric view of the line actuated spool and gear means completely removed from the invention for clarity.
Figure 6:
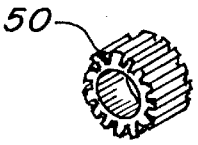
FIG. 6 is a partial isometric view of the spool spur gear completely removed from the invention for clarity.
Figure 7:
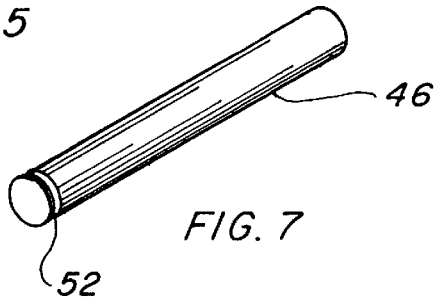
FIG. 7 is a partial isometric view of the spool shaft completely removed from the invention for clarity.
Figure 8:
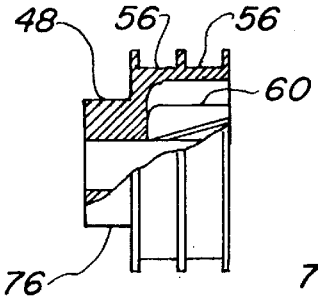
FIG. 8 is a partially cut away side view of the line spool completely removed from the invention for clarity.
Figure 9:
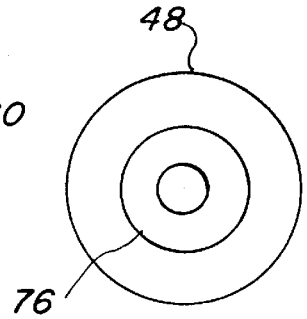
FIG. 9 is a rear view of the line spool.
Figure 10:
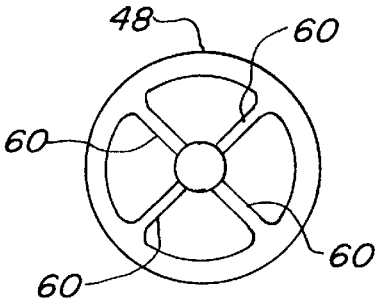
FIG. 10 is a front view of the line spool illustrating the internal reinforcing ribs.

This spool and gear means consists of a spool shaft 46, a line spool 48, and a spool spur gear 50 with the spool and gear attached to the shaft as shown in FIG. 5. The spool shaft 46 is depicted by itself in FIG. 7 and includes a groove 52 near one end to receive a retaining ring 54. The line spool 48 is illustrated by itself in FIGS. 8–10 and includes two separate circumferential grooves 56 for receiving and separating the two lines or cords 32 which are attached to the spool. Each groove 56 includes a through-bore 58 for attachment and termination of the lines. Each line 32 is wrapped around the spool 48 within the groove 56 and threaded into the through-bore 58 where a simple overhand knot or crimped sleeve holds the end of the line inside the spool, as illustrated with dotted lines in FIG. 18. The lines 32 penetrate the hole 29 in the head rail 28 when the tilter is installed. The spool 48 preferably includes a number of reinforcing fins 60, as depicted in FIGS. 8 and 10, which increases the structural integrity and stiffness of the component however, their presence is not essential for the invention to function. The tilter spool shaft 46, spool 48 and spool spur gear 50 may be formed of thermoplastic such as nylon, phenolic, polymide, acetal, polyester, or metal such as steel, iron, brass, aluminum, zinc composites and the like.

Figure 11:
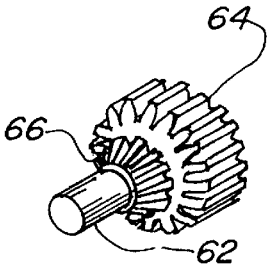
FIG. 11 is a partial isometric view of the reduction gear means completely removed from the invention for clarity.

Reduction gear means are in the form of a reduction gear shaft 62, a reduction spur gear 64, and a reduction beveled gear 66. The spur gear 64 and beveled gear 66 are mated contiguously together on the shaft 62, as shown in FIG. 11. The shaft 62 is positioned within the housing 22 parallel to the spool shaft 46, as illustrated in FIG. 18, such that the teeth of the spool spur gear 50 and the teeth of the reduction spur gear 64 intermesh as also shown in FIG. 18.

Figure 12:
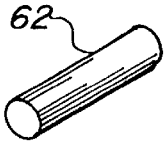
FIG. 12 is a partial isometric view of the reduction gear shaft completely removed from the invention for clarity.
Figure 13:
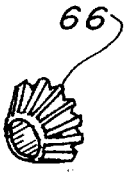
FIG. 13 is a partial isometric view of the beveled gear completely removed from the invention for clarity.
Figure 14:
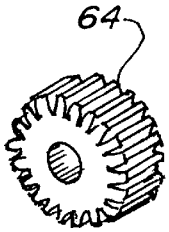
FIG. 14 is a partial isometric view of the spur gear completely removed from the invention for clarity.

FIGS. 12, 13 and 14 depict the reduction shaft 62, spur gear 64 and beveled gear 66 completely removed from the invention for clarity. The above shaft and gears may be made of the same material as the spool and gear means, and are likewise formed by injection molding.

Figure 15:
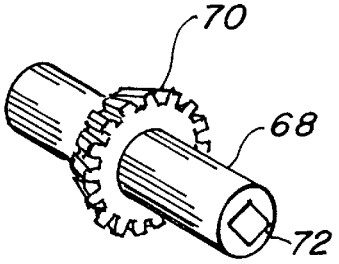
FIG. 15 is a partial isometric view of the tilt rod rotating means completely removed from the invention for clarity.
Figure 16:
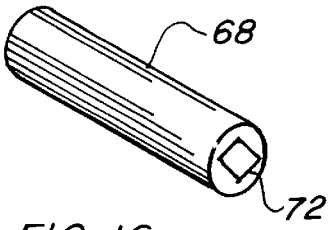
FIG. 16 is a partial isometric view of the adapter sleeve completely removed from the invention for clarity.
Figure 17:
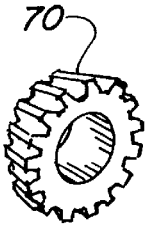
FIG. 17 is a partial isometric view of the tilt rod beveled gear completely removed from the invention for clarity.

Tilt rod rotating means include an adapter sleeve 68 and a tilt rod beveled gear 70 which is disposed upon the sleeve as shown in FIG. 15. The adapter sleeve 68 includes a hollow bore 72 that is located completely through its longitudinal length to accept a horizontal blind tilt rod 74, as shown in partial length in FIG. 1. It should be noted that the tilt rod 74 customarily runs almost the full length of the head rail 28 and interfaces with all of the ladder drums of the blind which transmit rotation from the tilter to the ladders of the blind. The tilt rod 74 is necessarily shown incompletely in FIG. 1, however its configuration and utility is well known in the art. Further, the tilt rod 74 is depicted as being square, however any other geometrical shape customarily used for this element may be substituted without affecting the invention. Again, the sleeve 68 and tilt rod beveled gear 70 may be the same material as the spool gear means.

Figure 18:
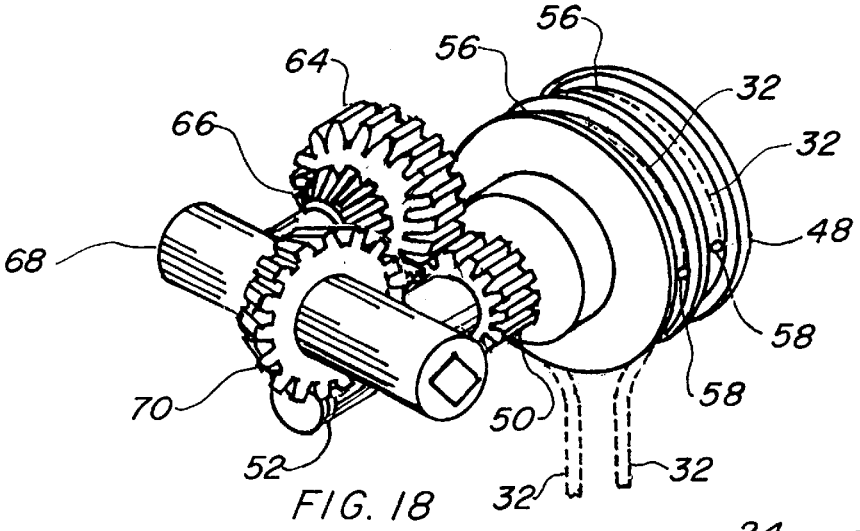
FIG. 18 is a partial isometric view of the combined spool and reduction gear means and tilt rod rotating means in their operational relationship with a line or cord shown in dashed lines wrapped around the spool and partially extending beneath for manual tilter operation.

FIG. 18 illustrates the shafts, sleeve, gears and spool in their operational relationship and, as previously discussed, rotating the spool 48 by pulling one of the lines 32 reverses the direction of rotation to the reduction gear shaft 62. It may be seen that the rotation is again reversed by the gears to the sleeve 68 producing the original rotational characteristic, thereby angling slats of the blind in the same direction front to rear as the position of the lines. It has been found that a rotational ratio of from 2:1 to 4:1 is ideal and easily accomplished by gear diameter selection such that when the spool means is rotated by the line or cord 32, the tilt rod means is increased in its rotational direction, thus allowing a short throw or pull on the cord to open or close the slats of the blind.

To assemble the tilter, the spool 48 and spur gear 50 are attached to the shaft 46 by chemical bonding, adhesive, ultra-sonic welding or the like, and the shaft 46 is inserted into the housing 22. A diametrical shoulder 76, which is integrally formed into the spool 48, rotatably interfaces with a shoulder receiving hole 78 in the housing 22, and the shaft 46 penetrates a spool shaft receiving hole 80 in an opposite side of the housing. A retaining ring 54 is snapped into the groove 56 in the shaft 46 to lock the shaft in place. The holes 78 and 80 are slightly larger in diameter than their mating parts, therefore the shaft 46 and spool 48 are free to rotate and the diminutive edge of the housing becomes a bearing surface.

The reduction spur gear 64 and beveled gear 66 are fastened to the reduction gear shaft 62, as above, and the assembly is placed into the housing with one end of the shaft 62 penetrating a reduction gear shaft receiving hole 82 which is located in the housing. The other end of the shaft 62 fits into a cradle 84 in the housing 22, as shown in FIG. 3. The gear cluster on the shaft 62 enters into a cavity within the housing limiting thus its lateral movement.

The tilt rod adapter sleeve 68 receives its mating beveled gear 70 and is attached in a similar manner as above. The sleeve 68 is then placed within semi-circular openings 86, which are located in the housing 22, as illustrated in FIG. 3, and the related gears intermesh.

The lid 34 is then placed over the housing 22 thereby mating the bosses 36 with the apertures 38. The lid is secured by threaded fasteners 40 in the form of sheet metal or self tapping screws. Alternate methods of securement may be utilized as previously discussed. A cavity 88 in the lid 34 encompasses the tilt rod beveled gear 70 and holds it rotatably in place. A keeper 90, shown in FIG. 21, spaces and retains the reduction gear shaft 62. Mating semi-circulator openings 86' in the lid retain the sleeve 68.

It should be seen that the spool and gear means, reduction gear means and tilt rod rotating means all revolve freely within the housing and lid. Attachment to the head rail 28 is simple as the lines 32 are wrapped around the spool 48 and threaded into the hole 29, and the entire tilter is then snapped into place with the beveled projection 24 interfacing with the hole 29, and the arm 42 wedged between the rail 28 and its flange 44 as shown in FIG. 1.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

We claim:

1. A tilter for horizontal slatted blinds, adapted to be mounted into a blind head rail having a rotating tilt rod therein, comprising:

a) a hollow housing having a lid and means for attachment to the head rail, b) line actuated spool and spur gear means rotatably disposed within the housing and lid, having means for attaching a pair of lines through the head rail for transmitting rotation to the blind by pulling downward on a line to achieve a desired angular position of the blind, c) reduction spur and beveled gear means pivotally joined to the housing and rotatably meshing with the spool and gear means, thus decreasing transmitted rotational movement, and d) tilt rod rotating means having a tilt rod bore pivotally joined to the housing and a beveled gear rotatably meshing with the reduction beveled gear means such that axial movement is transmitted to a tilt rod that penetrates through the bore for blind slat positioning.

2. The tilter as recited in claim 1 wherein said housing and lid are injection molded thermoplastic.

3. The tilter as recited in claim 1 wherein said means for attachment to the head rail further comprises a downward-protruding beveled projection integral with the housing bottom, and an outward extending arm integral with the lid, such that the arm intersects with a head rail flange and the projection snaps into a hole in the head rail.

4. The tilter as recited in claim 3 wherein said housing includes a pair of passages adjacent to the downward-protruding beveled projection to permit lines wrapped around said spool means to pass through for manual operation beneath the blind.

5. The tilter as recited in claim 1 wherein said line actuating spool and gear means further comprises a spool shaft with means to retain the shaft within the housing, a line spool disposed onto the spool shaft and a spool spur gear contiguous with the spool on the spool shaft.

6. The tilter as recited in claim 5 wherein said line spool further comprises two separate circumferential grooves for receiving and separating lines wrapped around and attached to the spool.

7. The tilter as recited in claim 6 wherein said circumferential grooves each having a bore therethrough for attachment and termination of lines.

8. The tilter as recited in claim 5 wherein said line spool further comprises a plurality of reinforcing fins integral therewith for increasing integrity and stiffness of the spool.

9. The tilter as recited in claim 5 wherein said spool shaft, spool and spool spur gear are thermoplastic.

10. The tilter as recited in claim 1 wherein said tilt rod rotating means further comprises an adapter sleeve having a cavity therethrough for accepting a horizontal blind tilt rod and a tilt rod beveled gear disposed upon the sleeve.

11. The tilter as recited in claim 10 wherein said adapter sleeve and tilt rod beveled gear are constructed of a thermoplastic.

12. The tilter as recited in claim 10 wherein said adapter sleeve and tilt rod beveled gear are constructed of a metal.

13. The tilter as recited in claim 1 further comprising a rotational ratio of from 2:1 to 4:1 from the actuating spool and gear means to the tilt rod rotating means, such that when the spool means is rotated by a line, the tilt rod means increases its rotational direction by said ratio.

14. A tilter for horizontal slatted blinds, adapted to be mounted into a blind head rail having a rotating tilt rod therein, comprising:

a) a hollow housing having a lid and means for attachment to the head rail, wherein said housing lid is affixed to the housing by threaded fasteners, b) line actuated spool and gear means rotatably disposed within the housing and lid, having means for attaching a pair of lines through the head rail for transmitting rotation to the blind by pulling downward on a line to achieve a desired angular position of the blind, c) reduction gear means pivotally joined to the housing and rotatably meshing with the spool and gear means, thus decreasing transmitted rotational movement, and d) tilt rod rotating means having a tilt rod bore pivotally joined to the housing and rotatably meshing with the reduction gear means such that axial movement is transmitted to a tilt rod that penetrates through the bore for blind slat positioning.

15. A tilter for horizontal slatted blinds, adapted to be mounted into a blind head rail having a rotating tilt rod therein, comprising:

a) a hollow housing having a lid and means for attachment to the head rail, b) line actuated spool and gear means rotatably disposed within the housing and lid, having means for attaching a pair of lines through the head rail for transmitting rotation to the blind by pulling downward on a line to achieve a desired angular position of the blind, c) reduction gear means pivotally joined to the housing and rotatably meshing with the spool and gear means, thus decreasing transmitted rotational movement, wherein said reduction gear means further comprises a reduction gear shaft, a reduction spur gear disposed onto the gear shaft, and a reduction beveled gear disposed on said gear shaft contiguous with the reduction spur gear, and d) tilt rod rotating means having a tilt rod bore pivotally joined to the housing and rotatably meshing with the reduction gear means such that axial movement is transmitted to a tilt rod that penetrates through the bore for blind slat positioning.

16. The tilter as recited in claim 15 wherein said reduction gear shaft, reduction spur gear and reduction beveled gear are constructed of a thermoplastic.

17. The tilter as recited in claim 15 wherein said reduction gear shaft, reduction spur gear and reduction beveled gear are constructed of a metal.

* * * * *